US007514650B2

(12) United States Patent
Melgaard et al.

(10) Patent No.: US 7,514,650 B2
(45) Date of Patent: Apr. 7, 2009

(54) CONTINUOUS INFRARED FURNACE

(75) Inventors: Hans L. Melgaard, North Oaks, MN (US); Matt Weierke, Farmington, MN (US)

(73) Assignee: Despatch Industries Limited Partnership, Lakeville, MN (US)

( * ) Notice: Subject to any disclaimer, the term of this patent is extended or adjusted under 35 U.S.C. 154(b) by 195 days.

(21) Appl. No.: 11/297,213

(22) Filed: Dec. 8, 2005

(65) Prior Publication Data

US 2008/0296283 A1 Dec. 4, 2008

(51) Int. Cl.
*F27B 9/06* (2006.01)
*F27B 9/00* (2006.01)

(52) U.S. Cl. ..... 219/388; 219/390; 219/391; 219/393; 219/395; 219/403; 219/401; 219/411; 219/521; 432/123; 432/121; 432/3; 432/137; 432/76; 432/144; 432/64; 392/411; 392/417; 374/208; 374/179

(58) Field of Classification Search ..... 219/388, 219/390–1, 393, 395, 401–411, 521; 392/417, 392/411; 432/121, 123, 137, 3, 76, 144, 432/64; 374/208, 179
See application file for complete search history.

(56) References Cited

U.S. PATENT DOCUMENTS 3,826,014 A 7/1974 Helding
4,097,226 A 6/1978 Erikson et al.
4,143,278 A 3/1979 Koch, II
4,515,265 A 5/1985 Hill
4,517,448 A * 5/1985 Crain et al. ..... 219/388
4,574,182 A 3/1986 Pescatore et al.
4,833,301 A 5/1989 Furtek
4,997,364 A 3/1991 McGrath et al.
5,088,921 A 2/1992 Csehi et al.
5,195,673 A 3/1993 Irish et al. ..... 228/18
5,579,981 A 12/1996 Matsumura et al.
5,611,476 A 3/1997 Soderlund et al.
5,911,486 A 6/1999 Dow et al.
5,934,178 A * 8/1999 Caridis et al. ..... 99/330
5,993,500 A 11/1999 Bailey et al.
6,091,055 A 7/2000 Naka et al.
6,120,585 A 9/2000 Inomata et al.
6,288,366 B1 9/2001 Dings
6,291,801 B1 9/2001 Guidotti et al.
6,328,558 B1 12/2001 Dover et al.
6,408,842 B1 6/2002 Herrera
6,512,206 B1 1/2003 McEntire et al.
6,780,225 B2 8/2004 Shaw et al.
2001/0055740 A1 12/2001 Bloom et al.
2005/0083988 A1 4/2005 Schaefer

* cited by examiner

*Primary Examiner*—Shawntina Fuqua
(74) *Attorney, Agent, or Firm*—Fredrikson & Byron, PA

(57) ABSTRACT

A furnace of controlled heating and treatment of material using infrared radiation. The furnace is capable of continuous infrared treating of material with consistent radiation being applied to the material, ease of access to the furnace for maintenance cleaning and repair, excellent control of radiant cooling of the material to be treated, and ease of maintenance of a volatile component condenser.

15 Claims, 6 Drawing Sheets

CONTINUOUS INFRARED FURNACE

FIELD OF THE INVENTION

The invention is directed to a continuous infrared furnace for heating and treating work pieces, and to techniques for improving performance, reliability, and maintainability of the same.

BACKGROUND OF THE INVENTION

Continuous infrared furnaces and ovens are widely used for in a variety of industries. Materials that may be treated in a continuous infrared furnace may include painted or coated materials that require specific curing conditions, components that require heat melt solder (i.e. ball grid arrays), pre-heating metals, circuit boards, silicon wafers treated through zone-melt processes, materials for use in photovoltaic cells requiring conductive paste to be fused thereto, and any other material that one can conceive of that is can benefit from controlled infrared radiation.

An infrared furnace provided with the ability to convey material through the furnace may be highly useful because heating and cooling zones provided throughout the furnace can provide any desired temperature profile in a consistent manner to a high volume of material to be treated. The high volume fabrication and treatment of heat processed or heat annealed devices entails many opportunities and challenges.

SUMMARY OF THE INVENTION

In one embodiment of a furnace in accordance with the invention a heat transfer zone for heating a material to be treated includes an upper portion and a lower portion. This embodiment includes a conveyor that transports material to be treated through the heat transfer zone along a direction of travel and a jack that allows movement of the lower portion of the heat transfer zone to allow access to the heat transfer zone. The heat transfer zone may include infrared lamps to heat the material to be treated, primarily through radiant heat transfer. These infrared lamps may be, for example, quartz, silicon carbide, or tungsten halogen lamps or any lamp known in the art. In some embodiments the conveyor may be a conveyor belt.

In another embodiment of a furnace in accordance with the invention a heat transfer zone for heating a material to be treated includes an upper portion and a lower portion. This embodiment includes a conveyor that transports material to be treated through the heat transfer zone along a direction of travel and a jack that allows movement of the lower portion of the heat transfer zone to allow access to the heat transfer zone. This embodiment may also include an air mover and a condenser with a heat transfer element. The air mover may be a fan, an eductor, or any device known in the art. The heat transfer element of this embodiment is removable from the condenser for cleaning and maintenance.

In another embodiment of a furnace in accordance with the invention a heat transfer zone for heating a material to be treated includes an upper portion and a lower portion. This embodiment includes a conveyor that transports material to be treated through the heat transfer zone along a direction of travel and a jack that allows movement of the lower portion of the heat transfer zone to allow access to the heat transfer zone. This embodiment has conveyor supports that are oriented more parallel than perpendicular to the direction of travel of the conveyor. The conveyor supports may be oriented slightly skew to the direction of travel. The conveyor supports may also be oriented so as to allow radiation from lamps on the other side of the conveyor supports to receive consistent radiation from those lamps across the surface of the material to be treated that is exposed to those lamps.

Another embodiment of a furnace in accordance with the invention has a heat transfer zone for heating a material to be treated, a cooling zone for cooling the material to be treated, a conveyor that transports material to be treated through the heat transfer zone and cooling zone along a direction of travel, and a radiant cooler in the cooling zone that uses water at a pressure of 60 psig or higher as a cooling medium.

Yet another embodiment of a furnace in accordance with the invention has a heat transfer zone for heating a material to be treated, a cooling zone for cooling the material to be treated, a conveyor that transports material to be treated through the heat transfer zone and cooling zone along a direction of travel, and a radiant cooler in the cooling zone that uses water at a pressure of 60 psig or higher as a cooling medium. In this embodiment the radiant cooler is black anodized to aid in radiant heat transfer to the radiant cooler.

In yet another embodiment, a furnace in accordance with the invention has a heat transfer zone for heating a material to be treated, a conveyor that transports material to be treated through the heat transfer zone along a direction of travel, and conveyor supports that are oriented more parallel than perpendicular to the direction of travel of the conveyor, wherein the conveyor supports are oriented slightly skew to the direction of travel.

In yet another embodiment, a furnace in accordance with the invention has a heat transfer zone for heating a material to be treated, a conveyor that transports material to be treated through the heat transfer zone along a direction of travel, and conveyor supports that are oriented more parallel than perpendicular to the direction of travel of the conveyor, wherein the conveyor supports are oriented slightly skew to the direction of travel. In this embodiment the conveyor supports may be oriented to allow consistent radiation to the material to be treated from lamps on the other side of the conveyor supports from the material to be treated.

DETAILED DESCRIPTION OF THE INVENTION

Figure 1:
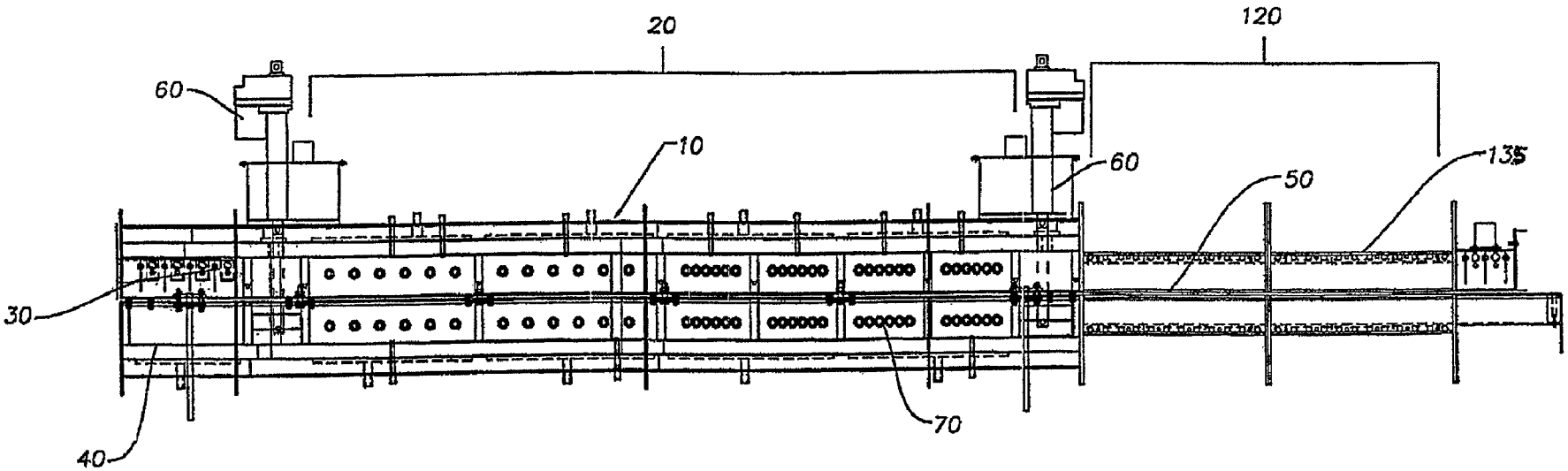
FIG. 1 is a side view of an embodiment of a furnace in accordance with the invention.

Turning now to the figures, FIG. 1 is a side view of an embodiment of a furnace in accordance with the invention. The furnace 10 has a heat transfer zone generally indicated at 20 for heating a material to be treated (not shown). The heat transfer zone 20 has an upper portion 30 and a lower portion 40. A conveyor 50 transports material to be treated through heat transfer zone 20 along a direction of travel. The conveyor 50 may be, for example, a conveyor belt, a walking beam, or other conveyor known in the art. A jack 60 allows movement of the lower portion 40 of the heat transfer zone 20 to allow access to the interior of the heat transfer zone 20 and to components therein. A jack 60, as used in this application, means a device for raising and lowering objects by means of force applied with a lever, screw, hydraulic press, or other means known in the art. The heat transfer zone 20 may also include one or more infrared lamps 70. These infrared lamps may be, for example, quartz, silicon carbide, or tungsten halogen lamps or any lamp known in the art. The lowering of the lower portion 40 of the heat transfer zone 20 by the jack 60 may allow, for example, for cleaning of the lower portion 40 without interference by the conveyor 50, more simple access for maintenance of other elements of the furnace 10, such as replacing lower lamps 70 or other elements of the furnace 10.

The access to the interior of the furnace 10 provided by moving the lower portion 40 of the furnace from the bottom of the furnace may allow for, among other things, maintenance or replacement of insulation, lamps, the conveyor, and other elements not easily accessible without moving the lower portion. Access to the lower portion 40 of the furnace also allows for the removal of material to be treated that has fallen from the conveyor 50, broken during processing, or otherwise collected in the lower portion 40 of the furnace.

Figure 2:
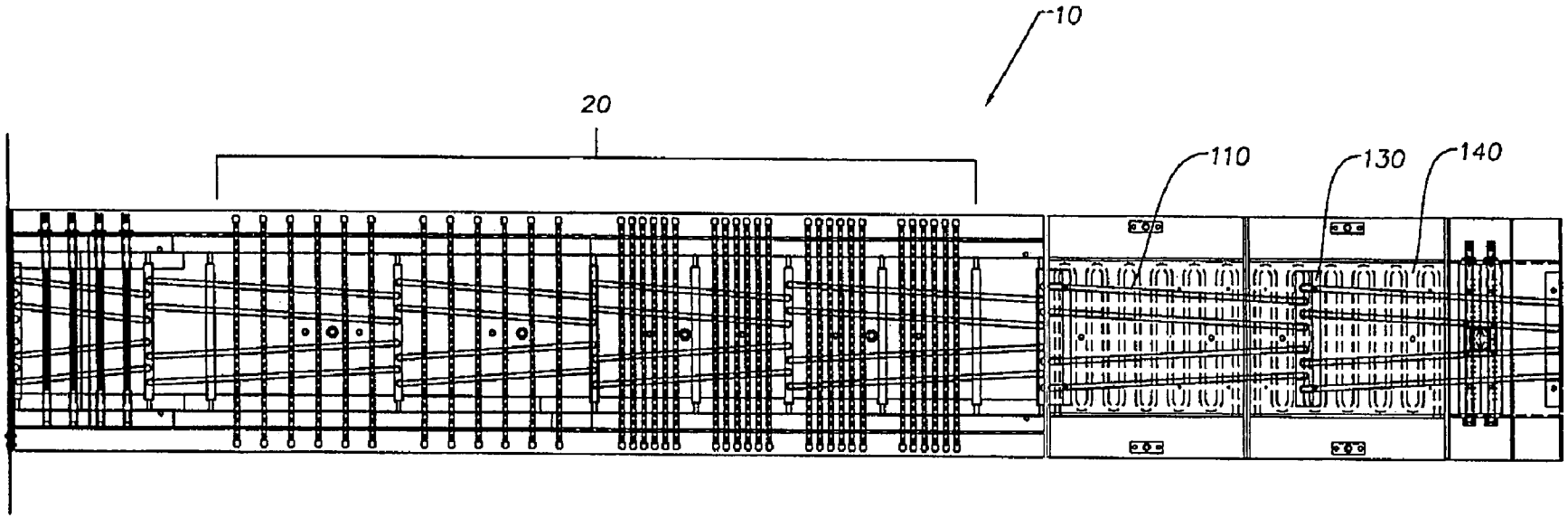
FIG. 2 is a top plan view of an embodiment of a furnace 10 in accordance with the invention.

FIG. 2 is a top plan view of an embodiment of a furnace 10 in accordance with the invention. The embodiment of FIG. 2 may include conveyor supports 110 that support the conveyor 50 (shown in FIG. 1). The conveyor supports 110 may, for example, be quartz rods or other material known in the art designed to withstand the severe environment within the furnace 10.

The conveyor supports 110 shown in the embodiment in FIG. 2 span between cross supports 130. Viewing this figure from left to right, the conveyor supports 110 are oriented in a repetitive converging fashion. That is, beginning at any particular cross member 130 and moving from left to right, the conveyor supports 110 are initially further spaced from each other and converged toward each other as you move toward the next cross support 130 to the right. In the exemplary embodiment shown in FIG. 2, this pattern repeats itself through the furnace 10.

By orienting the conveyor supports 110 in this fashion it is possible to increase the uniformity of the infrared radiation reaching the work pieces from the lower infrared lamps 70. In many prior art furnaces, conveyor supports are parallel to the direction of travel of the work pieces and are between the lower infrared lamps and the work pieces. These conveyor supports interfere with radiant heat transfer to the portion of the work pieces that is "shadowed" by these conveyor supports. This can result in inconsistent heating or treatment of work pieces. By orienting the supports in a non-parallel fashion or slightly skew fashion, embodiments of a furnace in accordance with the invention allow more consistent exposure of the work pieces to the infrared lamps on the other side of the supports. One can appreciate these embodiments by picturing a work piece traveling along a conveyor over a support that is parallel to the direction of travel wherein the support casts a "shadow" on the same area of the work piece throughout the travel, whereas a support that is slightly skew will "shadow" a different portion of the work piece as the work piece moves along the conveyor in the direction of travel. The supports could also be oriented in, for example, a herringbone, zigzag, repetitive diverging, or other orientation. Other orientations of conveyor supports 110 that will achieve this goal will occur to those skilled in the art upon reading this disclosure and are contemplated by this disclosure and the appended claims.

Embodiments of a furnace in accordance with this invention may also include a cooling zone generally indicated at 120. Cooling zone 120 may include a radiant cooler 140 to allow removal of heat from the work pieces.

Figure 3:
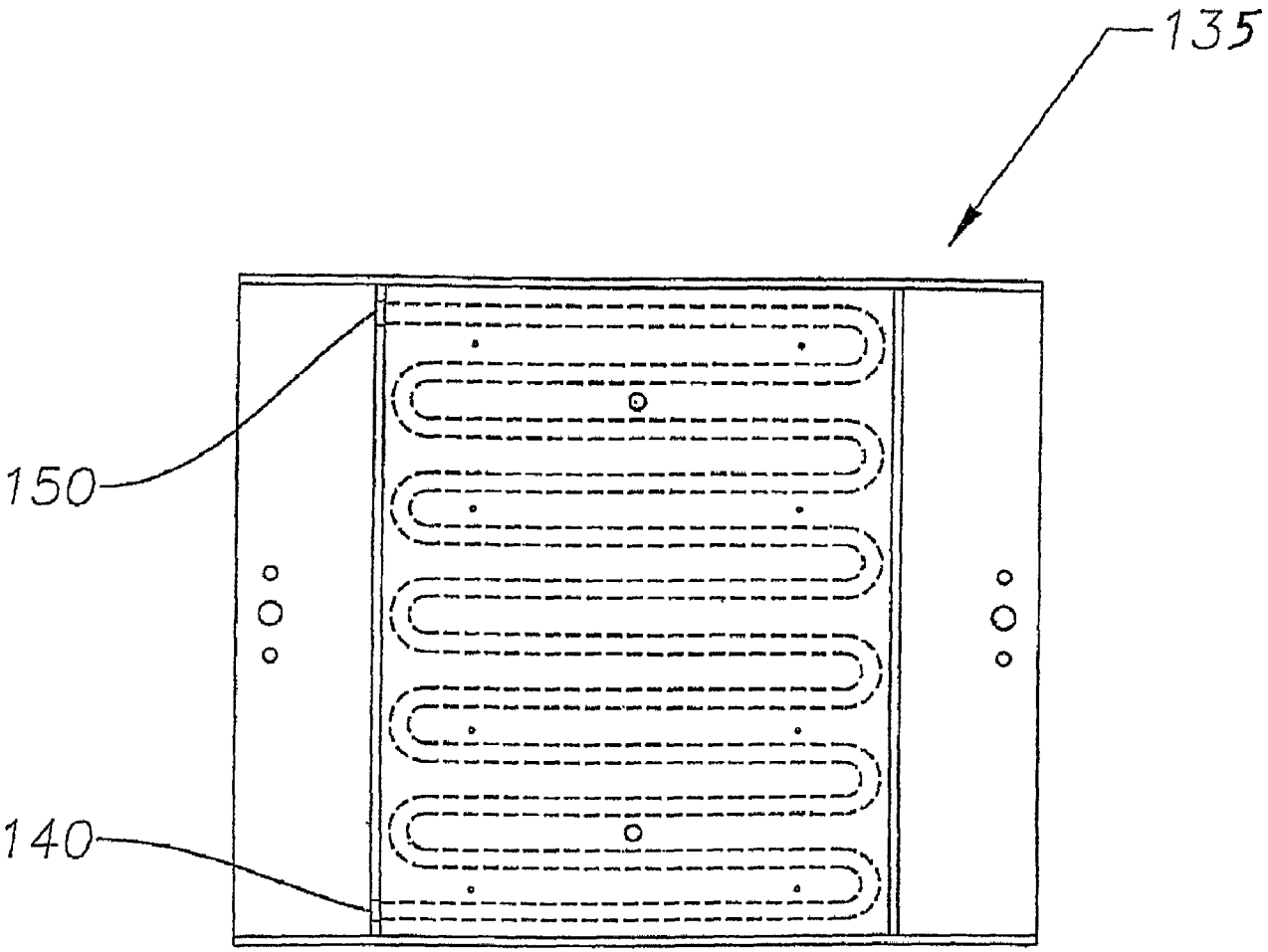
FIG. 3 is a cross section of a top plan view of an embodiment of a radiant cooler in accordance with the invention.

FIG. 3 is a cross section of a top plan view of an embodiment of a radiant cooler in accordance with the invention. The radiant cooler 135 has an inlet 140 and outlet 150 to allow a cooling medium to pass through the body of the radiant cooler 135. The radiant cooler 135 may be made of any material and may be coated with a non-reflective coating to enhance radiant heat transfer from the material to be treated to the radiant cooler. In one exemplary embodiment of the invention, the radiant cooler is made of aluminum and is black anodized to enhance heat transfer.

Figure 4:
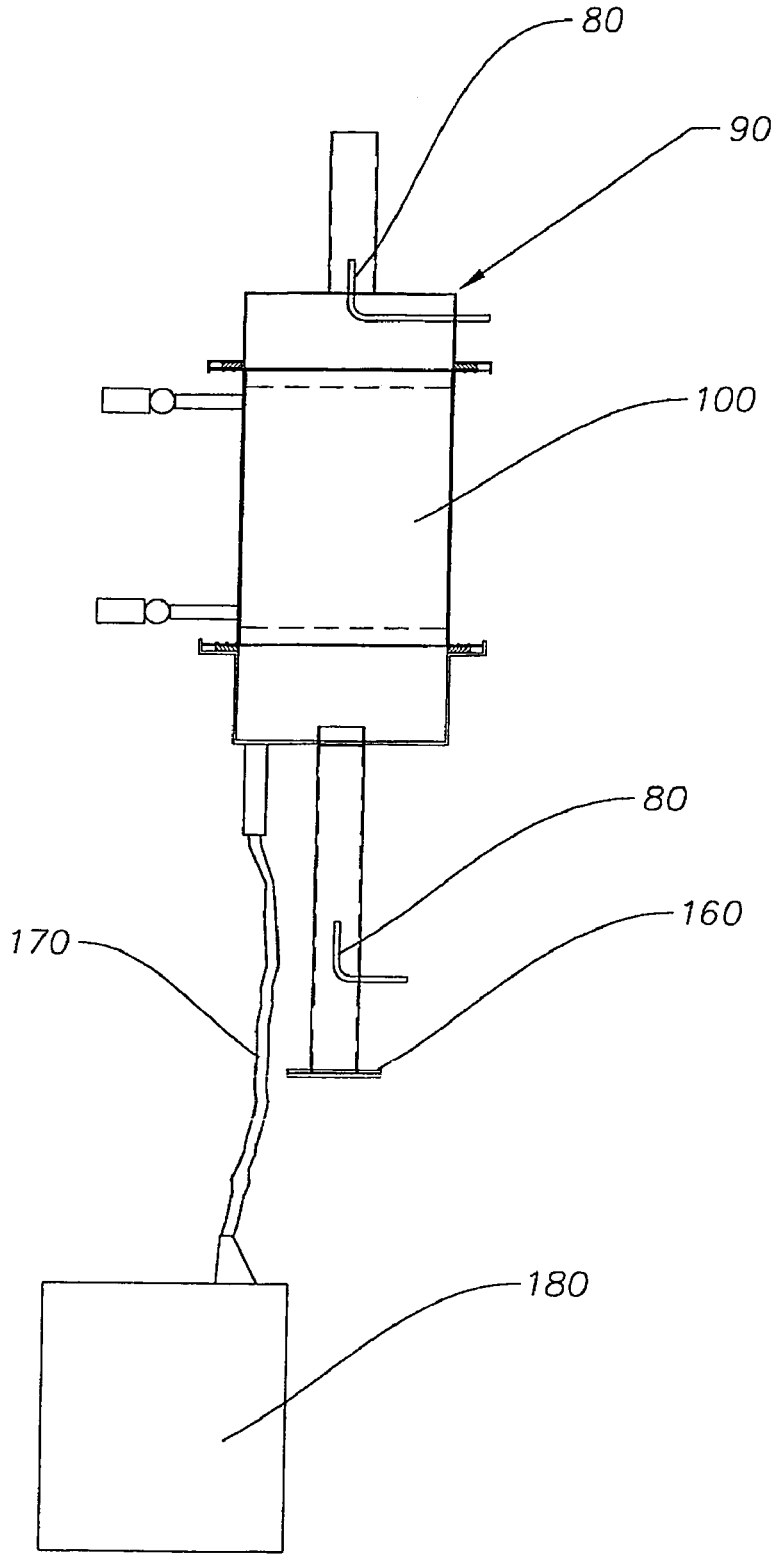
FIG. 4 is a side view of an embodiment of a condenser in accordance with the invention.

FIG. 4 is a side view of an embodiment of a condenser in accordance with the invention. Some embodiments of a furnace 10 in accordance with this invention may also include a condenser 90 having an air mover 80 and a heat transfer element 100. The air mover 80 may be a fan, an eductor, or any device known in the art. The condenser 90 may, for example, be mounted on the furnace 10 (not shown) using a flange 160. The air mover 80 may draw air through the furnace 10 to create a slight negative pressure within the furnace. The furnace may contain a controlled or inert atmosphere or simply ambient air. A controlled atmosphere that may be contained within the furnace may include a low or high oxygen atmosphere, a controlled humidity atmosphere, an atmosphere rich in any relevant gas or vapor, or other such atmosphere as may be required based on specific processing applications. Volatile materials driven from the work pieces are drawn through the air mover 80 into the condenser 90 so that, as possible, they may be condensed and recovered rather than released to the atmosphere. The condensed material may drain from the condenser 90 through a drain line 170 to a collection vessel 180. In some embodiments, the condenser 90 has a heat transfer element 100 which may be removed from the condenser 90 for cleaning, maintenance, or replacement.

Figure 5:
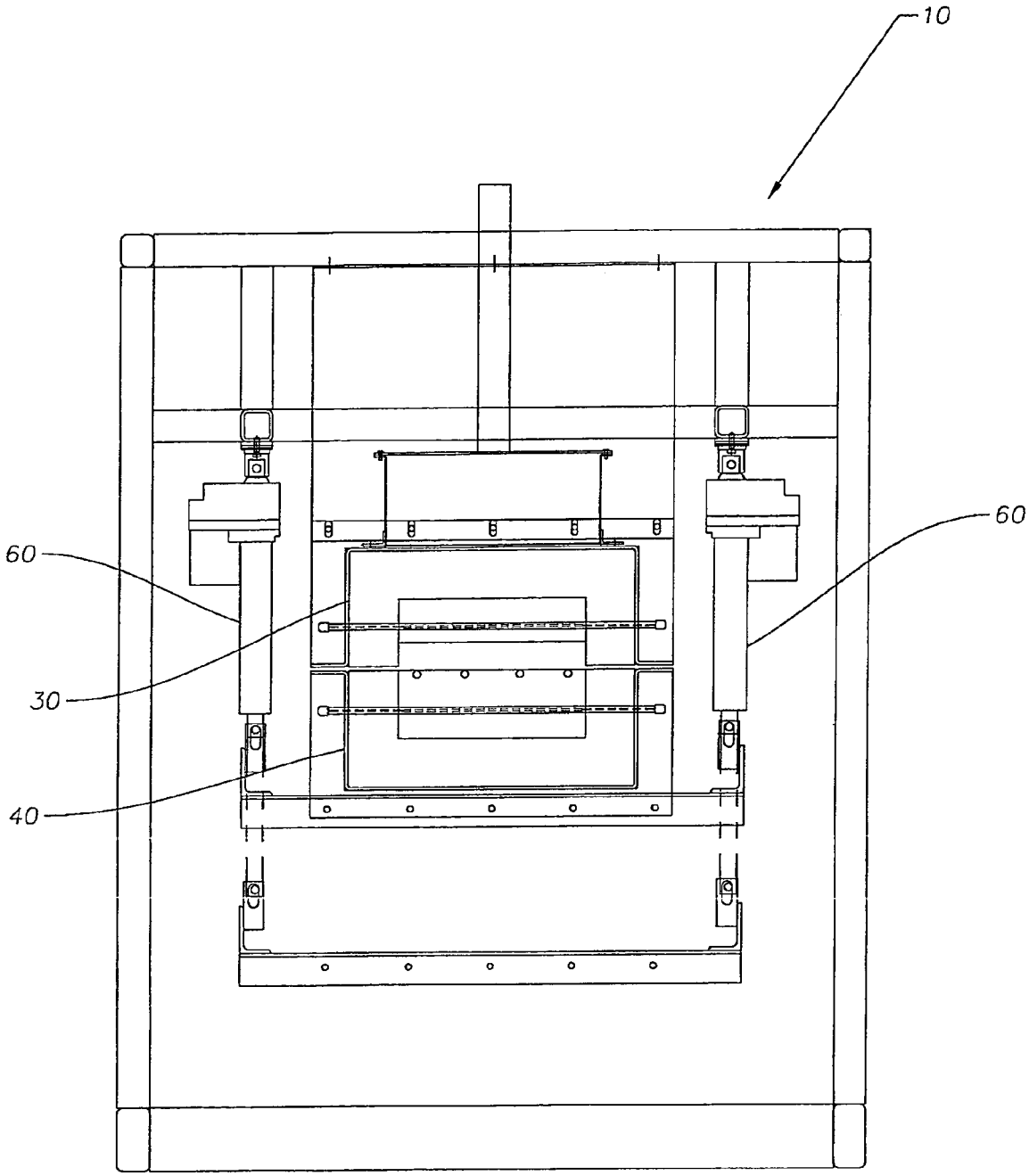
FIG. 5 is an end view of an embodiment of an oven in accordance with the invention.

FIG. 5 is an end view of an embodiment of an oven in accordance with the invention. The oven 10 of FIG. 5 has an upper portion 30 and a lower portion 40. Jacks 60 allow for the lowering of the lower portion 40 to provide access to the interior of the oven 10. The access to the interior of the furnace 10 provided by moving the lower portion 40 of the furnace from the bottom of the furnace may allow for, among other things, maintenance or replacement of insulation, lamps, the conveyor, and other elements not easily accessible without moving the lower portion. Access to the lower portion 40 of the furnace also allows for the removal of material to be treated that has fallen from the conveyor, broken during processing, or otherwise collected in the lower portion 40 of the furnace.

Figure 6:
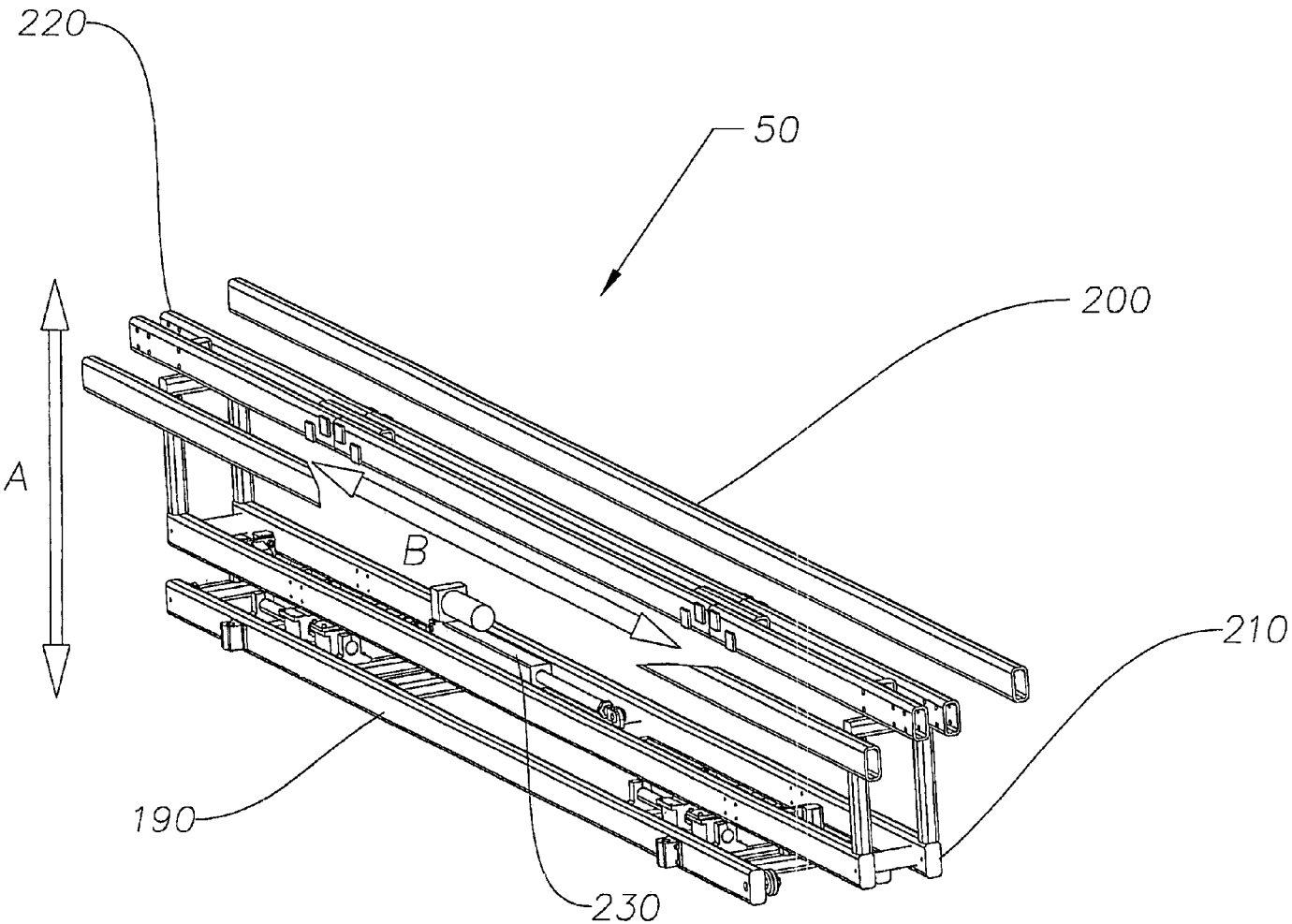
FIG. 6 is perspective view of an embodiment of a conveyor in accordance with the invention.

FIG. 6 is perspective view of an embodiment of a conveyor in accordance with the invention. The conveyor 50 of this embodiment is commonly referred to as a walking beam. The conveyor 50 conveys material to be treated (not shown) by repetitive moving of the material along one or more stationary beams 200. In the conveyor of this embodiment, a top frame 210 having at least one moving beam 220 is supported by base frame 190. An actuator 230 moves the top frame in a vertical direction indicated by arrow "A" and a horizontal direction indicated by arrow "B." A material to be treated (any number of individual items) may be placed on the stationary beam(s) 200. The actuator 230 moves the top frame 210 and the moving beams(s) 220 upward until it contacts the material to be treated and engages it enough to move it along the stationary beam(s) 200, possibly lifting it completely from the stationary beam(s) 200. The actuator 230 then advances the material to be treated along the conveyor 50 by moving the top frame 210 and the moving beam(s) 220 horizontally along a direction of travel. The actuator 230 then lowers the top frame 210 and the moving beam(s) 220 so that the material to be treated rests on the stationary beam(s) 200. The actuator 230 then moves the top frame 210 and the moving beam(s) 220 horizontally in a direction opposite the direction of travel before again moving them upward to engage the material to be treated and repeat the above steps. In this way, the conveyor 50 may move a material to be treated through an oven 10 by repeatedly advancing it along the stationary beam(s) 200.

While exemplary embodiments of this invention have been illustrated and described, it should be understood that various changes, adaptations, and modifications may be made therein without departing from the spirit of the invention and the scope of the appended claims.

What is claimed is:

1. A furnace comprising;

a. a heat transfer zone for heating a material to be treated having an upper portion and a lower portion;

b. a conveyor that transports material to be treated through the heat transfer zone along a direction of travel c. a jack that allows movement of the lower portion of the heat transfer zone to allow internal access to the heat transfer zone; and d. air mover and a condenser with a heat transfer element, wherein the heat transfer element of the condenser is removable for cleaning and maintenance.

2. The furnace of claim 1, wherein the heat transfer zone contains infrared lamps.

3. The furnace of claim 2, wherein the infrared lamps are selected from a group consisting of quartz lamps, silicon carbide lamps, and tungsten halogen lamps.

4. The furnace of claim 1, wherein the conveyor is a conveyor belt.

5. The furnace of claim 1, wherein the heat transfer element is made of stainless steel.

6. The furnace of claim 1, further comprising conveyor supports that are oriented more parallel than perpendicular to the direction of travel of the conveyor.

7. The furnace of claim 6, wherein the conveyor supports are oriented slightly skew to the direction of travel.

8. The furnace of claim 7, wherein the conveyor supports are oriented so as to allow consistent radiation to the material to be treated from lamps on the other side of the conveyor supports from the material to be treated.

9. The furnace of claim 6, wherein the conveyor supports are oriented in a herringbone fashion.

10. The furnace of claim 6, wherein the conveyor supports are oriented in a repetitive converging fashion.

11. The furnace of claim 6, wherein the conveyor supports are oriented in a zigzag fashion.

12. The furnace of claim 1, further comprising:

e. a cooling zone for cooling the material to be treated; and f. a radiant cooler in the cooling zone that uses water at a pressure of 60 psig or higher as a cooling medium;

wherein the conveyor transports the material to be treated through the heat transfer zone and the cooling zone along the direction of travel.

13. The furnace of claim 12, wherein the radiant cooler is black anodized.

14. The furnace of claim 12, wherein the radiant cooler is made of aluminum.

15. The furnace of claim 12, wherein the water used in the radiant cooler is at a pressure of 80 psig or greater.

* * * * *